US011642605B2

(12) United States Patent
Dumphy

(10) Patent No.: US 11,642,605 B2
(45) **Date of Patent: *May 9, 2023**

(54) BLOCK SYSTEM

(71) Applicant: Kejser, LLC, Mesa, AZ (US)

(72) Inventor: Joshua Dumphy, Mesa, AZ (US)

(73) Assignee: KEJSER, LLC, Mesa, AZ (US)

( * ) Notice: Subject to any disclaimer, the term of this patent is extended or adjusted under 35 U.S.C. 154(b) by 69 days.

This patent is subject to a terminal disclaimer.

(21) Appl. No.: 17/393,680

(22) Filed: Aug. 4, 2021

(65) Prior Publication Data

US 2021/0362071 A1 Nov. 25, 2021

Related U.S. Application Data

(60) Division of application No. 16/577,785, filed on Sep. 20, 2019, now Pat. No. 11,110,367, which is a continuation of application No. 15/858,038, filed on Dec. 29, 2017, now Pat. No. 10,456,702, which is a continuation-in-part of application No. 29/574,740, filed on Aug. 18, 2016, now Pat. No. Des. 828,458.

(51) Int. Cl.
*A63H 33/08* (2006.01)

(52) U.S. Cl.
CPC ..... *A63H 33/08* (2013.01); *A63H 33/082* (2013.01); *A63H 33/084* (2013.01); *A63H 33/086* (2013.01)

(58) Field of Classification Search
CPC ..... A63H 33/08; A63H 33/082; A63H 33/084
See application file for complete search history.

(56) References Cited

U.S. PATENT DOCUMENTS 2,157,992 A * 5/1939 Smith ..... E04B 2/28 52/427
3,158,963 A * 12/1964 Demaison ..... F27D 1/00 52/505
3,374,917 A * 3/1968 Troy ..... E04B 2/18 297/DIG. 2
4,041,670 A * 8/1977 Kaplan ..... E04B 2/18 52/592.2
4,381,619 A * 5/1983 Griffin ..... A63H 33/084 52/591.1

(Continued)

*Primary Examiner* — Eugene L Kim
*Assistant Examiner* — Christopher Glenn
(74) *Attorney, Agent, or Firm* — Snell & Wilmer L.L.P.

(57) ABSTRACT

A block may comprise a base comprising a first block side comprising a first side plane and a connective protrusion coupled to the base and extending distally outwardly and substantially perpendicularly from the first side plane. The connective protrusion may comprise a center pillar coupled to the base extending distally outward from the first side plane, a base portion coupled to the center pillar and the base and extending axially and substantially perpendicularly from the center pillar in a first direction, and an overhang portion coupled to the center pillar extending axially and substantially perpendicularly from the center pillar in a second direction opposite the first direction such that there is an overhang space between the first side plane and the overhang portion. The block may further comprise additional connective protrusions, and the connective protrusions of multiple blocks may enable the coupling of such blocks.

18 Claims, 8 Drawing Sheets

(56) References Cited

U.S. PATENT DOCUMENTS

| | | | | | |
|---|---|---|---|---|---|
| 4,633,639 | A * | 1/1987 | Deimen | A63H 33/084 | 446/124 |
| 4,740,188 | A * | 4/1988 | Coster | A63H 33/067 | 446/106 |
| 5,267,863 | A * | 12/1993 | Simmons, Jr. | A63F 9/0613 | 434/96 |
| 5,662,508 | A * | 9/1997 | Smith | A63H 33/08 | 493/137 |
| 5,928,052 | A * | 7/1999 | Buscher | A63H 33/10 | 446/124 |
| 6,517,071 | B2 * | 2/2003 | Gallant | A63F 9/10 | 273/157 R |
| 7,833,077 | B1 * | 11/2010 | Simmons, Jr. | A63H 33/08 | 446/85 |
| 8,845,381 | B2 * | 9/2014 | Ziegler | A63H 33/08 | 446/108 |
| 11,110,367 | B2 * | 9/2021 | Dumphy | A63H 33/084 | |
| 2007/0199257 | A1 * | 8/2007 | Thrush | E04F 15/10 | 52/180 |
| 2008/0104916 | A1 * | 5/2008 | Schmid | B28B 1/002 | 52/745.19 |
| 2008/0236081 | A1 * | 10/2008 | Kennedy | E04C 1/41 | 52/405.1 |
| 2016/0114255 | A1 * | 4/2016 | Jazouli | A63H 33/086 | 446/104 |

* cited by examiner

BLOCK SYSTEM

CROSS-REFERENCE TO RELATED APPLICATIONS

This application is a Continuation of, and claims priority to and the benefit of, U.S. Ser. No. 16/577,785, filed on Sep. 20, 2019 and entitled "BLOCK SYSTEM", which is a continuation of U.S. Ser. No. 15/858,038, filed Dec. 29, 2017 and entitled "BLOCK SYSTEM", which is a continuation-in-part of U.S. application Ser. No. 29/574,740, filed Aug. 18, 2016, entitled "TOY BLOCK," all of which are hereby incorporated by reference herein in their entireties.

FIELD

The present disclosure generally relates blocks, and more specifically, blocks that can be coupled together.

BACKGROUND

Blocks used as toys, or for construction, may be stacked or otherwise disposed next or adjacent to one another. However, without the blocks being coupled to one another, they may shift, rotate, or otherwise stray from their desired place or arrangement.

SUMMARY

Systems and methods are disclosed relating to a block system. In various embodiments, a block may comprise a base comprising a first block side, wherein the first block side comprises a first side plane defining a first base surface, the first base surface being a distally innermost surface on the first block side. The block may further comprise a middle connective protrusion coupled to the base and extending distally outwardly and substantially perpendicularly from the base and the first side plane, wherein the middle connective protrusion is adjacent to the first base surface. The middle connective protrusion may comprise a middle center pillar coupled to the base extending distally outward from the base and the first side plane for a middle center pillar length, a middle base portion coupled to the middle center pillar and the base and extending axially and substantially perpendicularly from the middle center pillar in a first direction for a middle base portion length, wherein the middle base portion comprises a middle base portion width being the distance the middle base portion extends distally outward from the base and the first block side, and a middle overhang portion coupled to the middle center pillar extending axially and substantially perpendicularly from the middle center pillar in a second direction opposite the first direction for a middle overhang portion length such that there is a middle overhang space between the first block side and the middle overhang portion. The middle overhang portion may comprise a middle overhang portion width being the distal distance of the middle overhang portion spanning from the middle overhang space to a middle protrusion top surface of the middle connective protrusion. The middle overhang space may comprise a middle overhang space width, which may be the distal distance between the first block side and the middle overhang portion, and wherein the middle overhang space width is equal to the middle base portion width.

In various embodiments, a block may further comprise a lateral connective protrusion coupled to the first block side and extending distally outwardly from the first block side.

The lateral connective protrusion may be disposed axially along the first block side in the first direction from the middle connective protrusion such that there is a second base surface having a second base surface length spanning between the lateral connective protrusion and a middle base portion end surface of the middle base portion. In various embodiments, the lateral connective protrusion may have a structure similar to the structure of the middle connective protrusion.

In various embodiments, a block may comprise additional block sides comprising at least one connective protrusion (e.g., similar to or the same as the middle connective protrusion and/or the lateral connective protrusion). In various embodiments, a block may comprise additional block sides, at least one of which may be a flush side comprising no connective protrusions. In various embodiments, the connective protrusion of one block may couple or engage with, and/or be disposed adjacent to, the connective protrusion of another block, such that the blocks are coupled, creating a block system.

In various embodiments, a block tool may comprise a middle connective protrusion coupled to a first end surface of the block tool. The middle connective protrusion of the block tool may have a similar structure to that of the middle connective protrusion of a block, as described herein. Similarly, in various embodiments, the block tool may comprise a lateral connective protrusion similar to the lateral connective protrusion of a block, as described herein. The connective protrusion of a block tool may be configured to couple or engage with, and/or be disposed adjacent to, the connective protrusions of a block, such that the first end of the block tool and the block are coupled. In various embodiments, a second end of the block tool may comprise a second end surface and a coupling protrusion extending perpendicularly from the second end surface, wherein the coupling protrusion comprises a coupling perimeter defining a coupling cutout, wherein the coupling cutout comprises a cutout floor which may be axially outward of the second end surface.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. Elements with the like element numbering throughout the figures are intended to be the same.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1A:
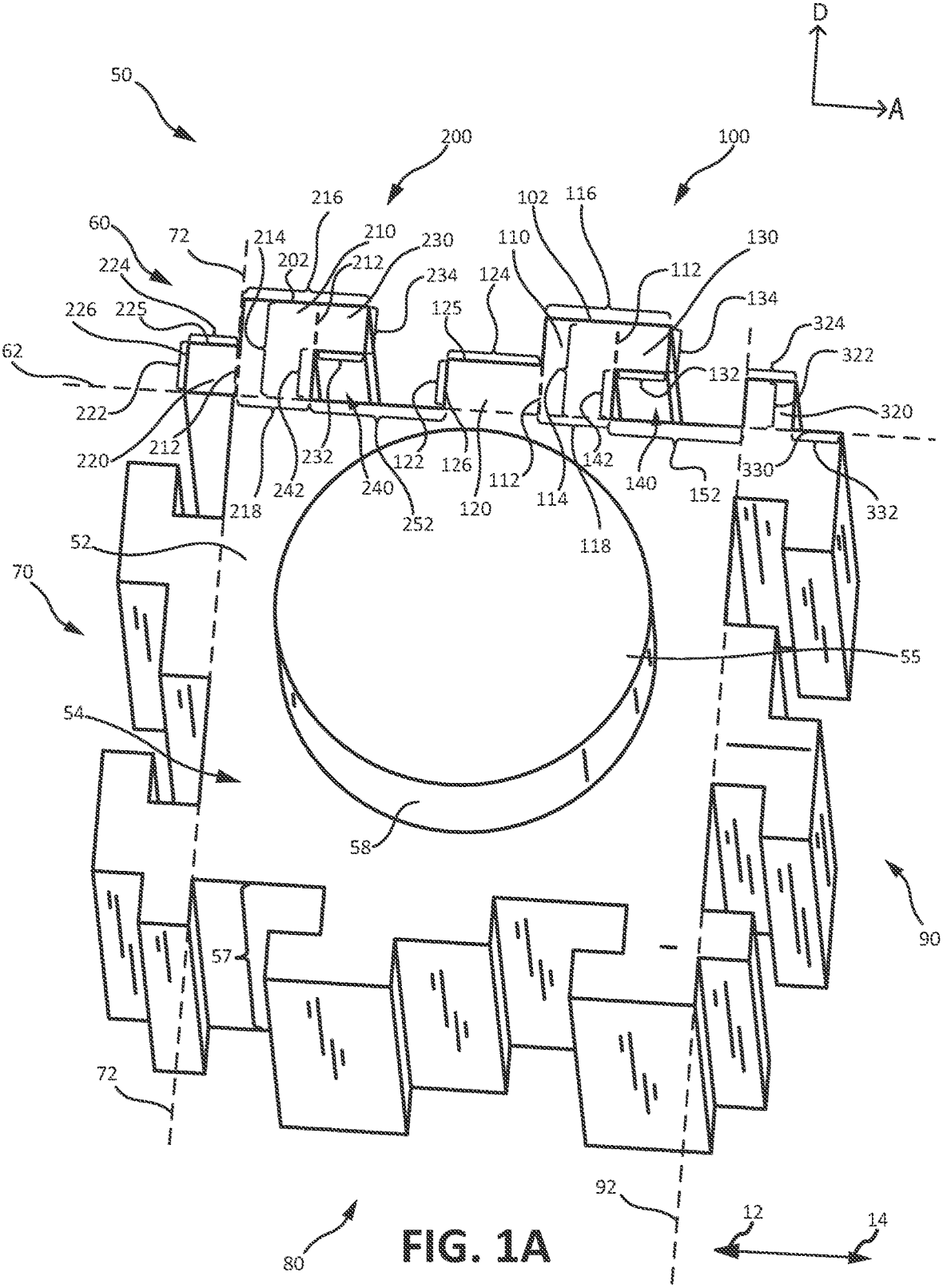
FIGS. 1A and 1B illustrate perspective views of a block with four connective sides, in accordance with various embodiments.
Figure 1B:
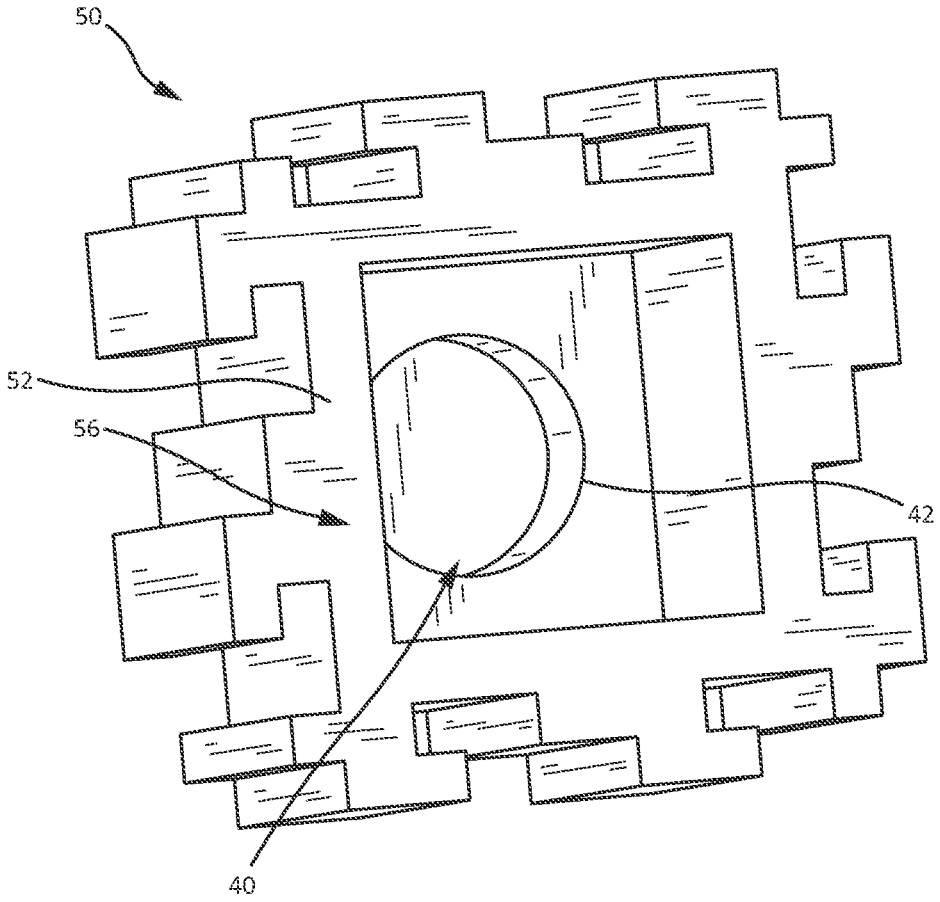

In various embodiments, and with reference to FIGS. 1A and 1B, a block 50 may comprise a base 52 comprising a plurality of block sides 60, 70, 80, 90. In various embodiments, block 50 may comprise any suitable number of sides, such as four sides, as depicted in FIG. 1A, or three sides, six sides, or the like. Each side may comprise a side plane (e.g., side plane 62 on block side 60), from which connective elements of the blocks protrude. Base 52 may comprise a top surface 54, a bottom surface 56, and a height 57 therebetween. Top surface 54 may comprise a top insert 55 protruding from top surface 54 substantially perpendicularly (as used in this context only, "substantially" means plus or minus 10 degrees from perpendicular). Top insert 55 may comprise an insert edge 58 defining the shape of top insert 55, wherein insert edge 58 has a height. Bottom surface 56 may comprise a bottom cutout 40 defined by a cutout edge 42. Bottom cutout 40 may extend through bottom surface 56 to any suitable depth within base 52 and/or top insert 55. Cutout edge 42 may define the shape of bottom cutout 40, which may be complementary to the shape of top insert 55, such that top insert 55 of one block 50 may be inserted into the bottom cutout 40 of another block 50. Top insert 55 of one block 50 may fit tightly into bottom cutout 40 of another block 50, such that the two blocks are coupled.

In various embodiments, block 50 may comprise a block side 60 having one or more connective protrusions configured to allow block 50 to couple with another block 50 by engaging the connective protrusions of the other block 50. In that regard, a middle connective protrusion 100 (a connective protrusion) may be coupled to block side 60 and protrude substantially perpendicularly from base 52 and side plane 62 (wherein "substantially" means, in this context only, plus or minus 10 degrees from perpendicular). In various embodiments, middle connective protrusion 100 may be disposed in any suitable location along block side 60. Middle connective protrusion 100 may be adjacent to one or more base surfaces (e.g., base surfaces 152, 252), which are surfaces along block side 60 and side plane 62, and/or the distally innermost surfaces on block side 60. An A-D axis has been included in FIG. 1A with respect to block side 60 to illustrate the axial (A) and distal (D) directions. For clarity, axial axis A spans parallel to side plane 62. As utilized herein, distally inward refers to the negative D direction towards base 52, and distally outward refers to the D direction away from base 52. For other sides of block 50, the A-D axis would be rotated such that the axial direction is parallel to the respective side plane, and the D direction is away from base 52. Middle connective protrusion 100 may be configured to facilitate the coupling of block 50 with another block 50 by couple to, or engaging with, a connective protrusion of the other block 50.

In various embodiments, middle connective protrusion 100 may be disposed between base surfaces 152, 252. In various embodiments, middle connective protrusion 100 may comprise a middle center pillar 110 coupled to base 52, defined by dotted lines 112. Middle center pillar 110, having a middle center pillar width 118, may extend distally and substantially perpendicularly from base 52 and side plane 62 for a middle center pillar length 114. In various embodiments, middle connective protrusion 100 may further comprise a middle base portion 120 coupled to middle connective protrusion 100 and base 52. Middle base portion 120 may extend axially and substantially perpendicularly in a first direction 12 from middle center pillar 110 for a middle base portion length 124 (an axial distance), having a middle base portion end surface 126 on the opposite end of middle base portion length 124 than middle center pillar 110. Middle base portion 120 may have a middle base portion width 122, which is the distal width middle base portion 120 spans from base 52 to a middle base portion upper surface 125, the distally outermost surface of middle base portion 120. As used in this context, "substantially" means plus or minus 10 degrees from perpendicular.

In various embodiments, middle connective protrusion 100 may further comprise a middle overhang portion 130 coupled to middle center pillar 110 and protruding axially and substantially perpendicularly from middle center pillar 110 in a second direction 14 for a middle overhang portion length 132. Middle overhang portion 130 may be coupled to middle center pillar 110 above middle base portion width 122 on middle center pillar 110 such that there is a middle overhang space 140 between side plane 62 and middle overhang portion 130. A middle overhang portion width 134 of middle overhang portion 130 may span distally between middle overhang space 140 and a middle protrusion top surface 102. Middle protrusion top surface 102 may have a length 116 equal and/or complementary to the combined lengths of middle center pillar width 118 and middle overhang portion length 132. A middle overhang space width 142 of middle overhang space 140, the distal distance of middle overhang space 140 between base 52 (and/or side plane 62) and middle overhang portion 130, in various embodiments, may be equal and/or complementary to middle base portion width 122. In various embodiments, middle connective protrusion 100 may couple with another block 50 by engaging a connective protrusion, or a portion thereof, of the other block 50 being disposed within middle overhang space 140. As used in this context, "substantially" means plus or minus 10 degrees from perpendicular.

In various embodiments, middle connective protrusion 100 may be integral with base 52. In various embodiments, the components of middle connective protrusion 100 may be integral with one another. That is middle center pillar 110, middle base portion 120, and/or middle overhang portion 130 may be integral with one another. As used herein, "integral" means unitary, such that there are no splits in the material between the integral parts, and/or that the integral parts are monolithic.

In various embodiments, block side 60 may alternatively or additionally comprise a lateral connective protrusion 200 (a connective protrusion). Lateral connective protrusion 200 may be disposed axially along side plane 62 in any suitable location. For example, lateral connective protrusion 200 may be coupled to base 52 an axial distance from middle connective protrusion 100. Lateral connective protrusion 200 may be disposed a distance in first direction 12 from middle connective protrusion 100 such that base surface 252, having a base surface length, is between lateral connective protrusion 200 and middle connective protrusion 100. In various embodiments, lateral connective protrusion 200 may be disposed a distance in second direction 14 from middle connective protrusion 100. In various embodiments, lateral connective protrusion 200 may be disposed on, adjacent, or proximate to the side plane of another side of base 52 (e.g., side plane 72 of block side 70).

In various embodiments, lateral connective protrusion 200 may comprise a lateral center pillar 210 coupled to base 52 defined by dotted lines 212. Lateral center pillar 210, having a lateral center pillar width 218, may extend distally and substantially perpendicular from base 52 and side plane 62 for a lateral center pillar length 214. In various embodiments, lateral connective protrusion 200 may further comprise a lateral base portion 220 coupled to lateral center pillar 210. lateral base portion 220 may extend axially and substantially perpendicularly in first direction 12 from lateral center pillar 210 for a lateral base portion length 224 (an axial distance), having a lateral base portion end surface 226 on the opposite end of lateral base portion length 224 than middle center pillar 110. Lateral base portion 220 may have a lateral base portion width 222, which is the distal width lateral base portion 220 spans from base 52 to a lateral base portion upper surface 225, the distally outermost surface of lateral base portion 220. As used in this context, "substantially" means plus or minus 10 degrees from perpendicular.

In various embodiments, lateral connective protrusion 200 may further comprise a lateral overhang portion 230 coupled to lateral center pillar 210 and protruding axially and substantially perpendicularly from lateral center pillar 210 in second direction 14 for a lateral overhang portion length 232. Lateral overhang portion 230 may be coupled to lateral center pillar 210 above lateral base portion width 222 on lateral center pillar 210 such that there is a lateral overhang space 240 between block side 60 (and/or side plane 62) and lateral overhang portion 230. A lateral overhang portion width 234 of lateral overhang portion 230 may span distally between lateral overhang space 240 and a lateral protrusion top surface 202. Lateral protrusion top surface 202 may have a length 216 equal and/or complementary to the combined lengths of lateral center pillar width 218 and lateral overhang portion length 232. A lateral overhang space width 242 of lateral overhang space 240, the distal distance of lateral overhang space 240 between base 52 (and/or side plane 62) and lateral overhang portion 230, in various embodiments, may be equal and/or complementary to lateral base portion width 222. In various embodiments, lateral connective protrusion 200 may couple with another block 50 by engaging a connective protrusion, or a portion thereof, of the other block 50 being disposed within lateral overhang space 240. As used in this context, "substantially" means plus or minus 10 degrees from perpendicular.

In various embodiments, lateral connective protrusion 200 may be integral with base 52. In various embodiments, the components of lateral connective protrusion 200 may be integral with one another. That is lateral center pillar 210, lateral base portion 220, and/or lateral overhang portion 230 may be integral with one another.

In various embodiments, block side 60 may alternatively or additionally comprise a singular protrusion 320 (a connective protrusion). Singular protrusion 320 may be disposed axially along side plane 62 in any suitable location. For example, singular protrusion 320 may be coupled to base 52 an axial distance along side plane 62 from middle connective protrusion 100 or lateral connective protrusion 200. Singular protrusion 320 may be disposed a distance in second direction 14 from middle connective protrusion 100 such that base surface 152 having a base surface length is between middle connective protrusion 100 and singular protrusion 320. In various embodiments, singular protrusion 320 may be disposed a distance in first direction 12 from middle connective protrusion 100. In various embodiments, singular protrusion 320 may be disposed on, adjacent, or proximate to the side plane of another side of base 52 (e.g., side plane 92 of block side 90). Singular protrusion 320, may have a singular protrusion width 324, and may be coupled to base 52 and extend distally from base 52 and side plane 62 for a singular protrusion length 322. In various embodiments, side 60 may comprise an outer surface 330, which spans an outer surface length 332. In various embodiments, singular protrusion 320 may be integral with base 52.

In various embodiments, singular protrusion 320 may be the lateral overhang portion 230 of another side of block 50 (e.g., side 90), and outer surface 330 may be a surface of the lateral center pillar 210 of another side (e.g., side 90). Similarly, in various embodiments, lateral base portion 220 of lateral connective protrusion 200 may be the singular protrusion 320 of another side of block 50 (e.g., side 70).

In various embodiments, lateral overhang space width 242 may be equal and/or complementary to middle overhang portion width 134 such that the middle overhang portion 130 of one block 50 may be disposed in the lateral overhang space 240 of another block 50 to couple the two blocks together. Similarly, in various embodiments, middle overhang space width 142 may be equal and/or complementary to lateral overhang portion width 234 such that the lateral overhang portion 230 of one block 50 may be disposed in the middle overhang space 140 of another block 50 to couple the two blocks together. Therefore, the middle overhang portion 130 and lateral overhang portion 230 of one block 50 may be disposed in the lateral overhang space 240 and middle overhang space 140, respectively, of another block 50 to couple the two blocks together. Along similar lines, the length of base surface 252 may be equal and/or complementary to middle protrusion top surface 102, such that middle protrusion top surface 102 is adjacent to base surface 252 in response to two blocks being coupled together. The length of base surface 152 may be equal and/or complementary to lateral protrusion top surface 202, such that lateral protrusion top surface 202 is adjacent to base surface 152 in response to two blocks being coupled together. In various embodiments, singular protrusion length 322 may be equal and/or complementary to the difference between lateral center pillar length 214 and lateral base portion width 222. Also, singular protrusion width 324 may be equal and/or complementary to lateral base portion length 224. Therefore, in the coupling of two blocks 50, singular protrusion 320 may be disposed adjacent to lateral base portion 220, wherein singular protrusion width 324 is adjacent to lateral base portion upper surface 225. An example of a block system comprising two blocks coupled together having sides similar to side 60 of block 50 is depicted in, and discussed in relation to, FIG. 2.

Figure 2:
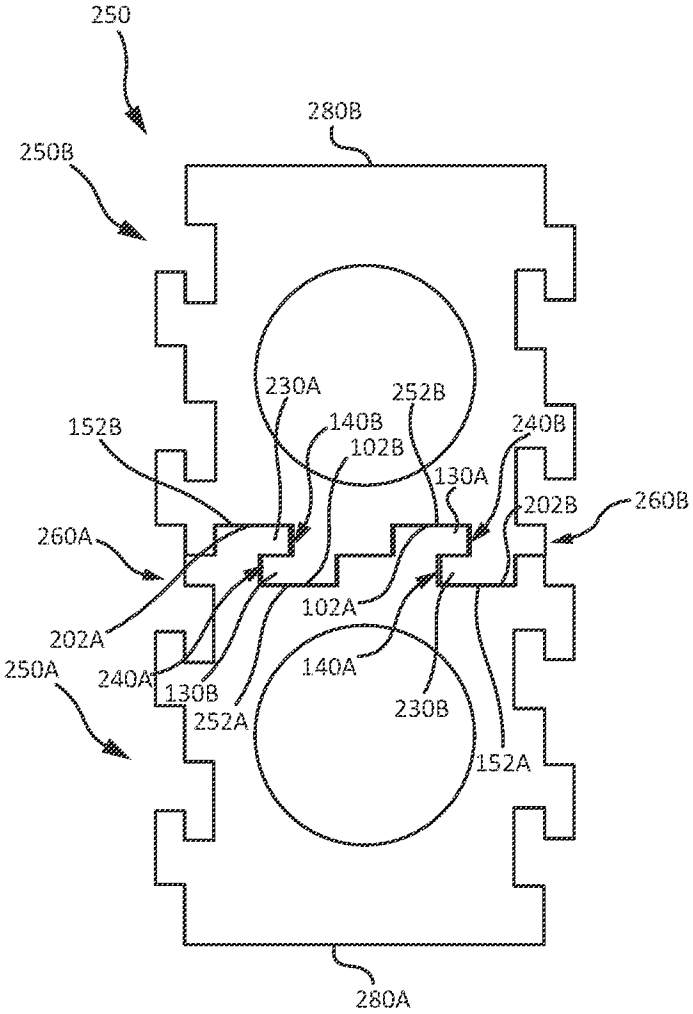
FIG. 2 illustrates blocks coupled together having three connective sides each, in accordance with various embodiments.

In various embodiments, additional sides of block 50 may comprise the configuration of connective protrusions described in relation to side 60. For example, as depicted in FIGS. 1A and 1B, every side of block 50 (i.e., sides 60, 70, 80, and 90) may comprise a connective protrusion, such that each side 60, 70, 80, and 90 may couple with a side of another block 50 having a connective protrusion. As shown in FIG. 2, depicting a block system 250 comprising two blocks 250A and 250B, block side 260A of block 250A may couple with block side 260B of block 250B. Block sides 260A and 260B may comprise the same configuration of connective protrusions as discussed in regard to block side 60 of block 50 depicted in FIGS. 1A and 1B. In that regard, with combined reference to FIGS. 1A, 1B, and 2, in various embodiments, lateral overhang portion 230B of block side 260B (similar to lateral overhang portion 230 of block side 60, with similar dimensions) may be disposed in middle overhang space 140A of block side 260A (similar to middle overhang space 140 of block side 60, with similar dimensions). Reciprocally, middle overhang portion 130A of block side 260A (similar to middle overhang portion 130 of block side 60, with similar dimensions) may be disposed in lateral overhang space 240B of block side 260B (similar to lateral overhang space 240 of block side 60, with similar dimensions). Middle overhang portion 130B of block side 260B (similar to middle overhang portion 130 of block side 60, with similar dimensions) may be disposed in lateral overhang space 240A of block side 260A (similar to lateral overhang space 240 of block side 60, with similar dimensions). Reciprocally, lateral overhang portion 230A of block side 260A (similar to lateral overhang portion 230 of block side 60, with similar dimensions) may be disposed in middle overhang space 140B of block side 260B (similar to middle overhang space 140 of block side 60, with similar dimensions). Base surface 252A (similar to base surface 252 of block side 60, with similar dimensions) may be adjacent to middle protrusion top surface 102B (similar to middle protrusion top surface 102 of block side 60, with similar dimensions). Reciprocally, base surface 252B (similar to base surface 252 of block side 60, with similar dimensions) may be adjacent to middle protrusion top surface 102A (similar to middle protrusion top surface 102 of block side 60, with similar dimensions). Likewise, base surface 152A (similar to base surface 152 of block side 60, with similar dimensions) may be adjacent to lateral protrusion top surface 202B (similar to lateral protrusion top surface 202 of block side 60, with similar dimensions). Reciprocally, base surface 152B (similar to base surface 152 of block side 60, with similar dimensions) may be adjacent to lateral protrusion top surface 202A (similar to lateral protrusion top surface 202 of block side 60, with similar dimensions).

Figure 4:
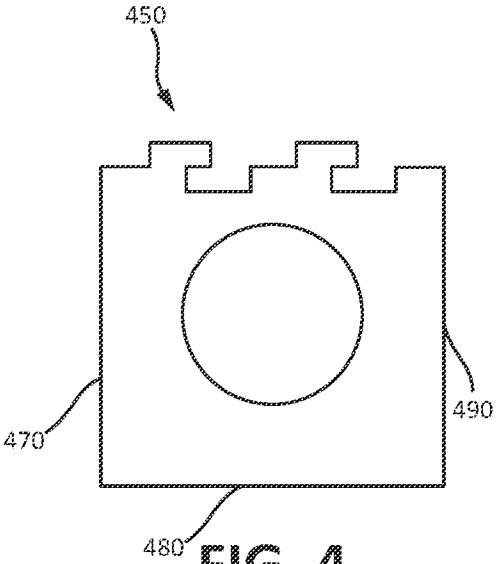
FIG. 4 illustrates a block having one connective side, in accordance with various embodiments.
Figure 3:
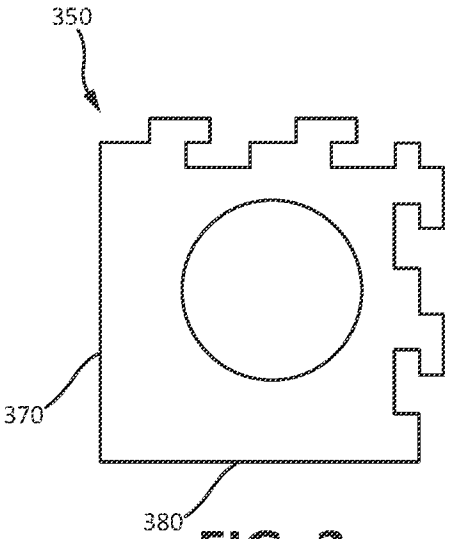
FIG. 3 illustrates a block having two connective sides, in accordance with various embodiments.

In various embodiments, a block may comprise one or more flush sides, which do not comprise a connective protrusion. For example, in FIG. 2, blocks 250A, 250B each comprise one flush side 280A, 280B, respectively, and three block sides comprising connective protrusions (similar to block side 60 in FIG. 1A). As depicted in FIG. 3, a block 350 may comprise two flush sides 370, 380, and two block sides comprising connective protrusions (similar to block side 60 in FIG. 1A). Block 350 may be a corner block. As depicted in FIG. 4, a block 405 may comprise three flush sides 470, 480, 490, and one side comprising connective protrusions (similar to block side 60 in FIG. 1A).

Figure 5A:
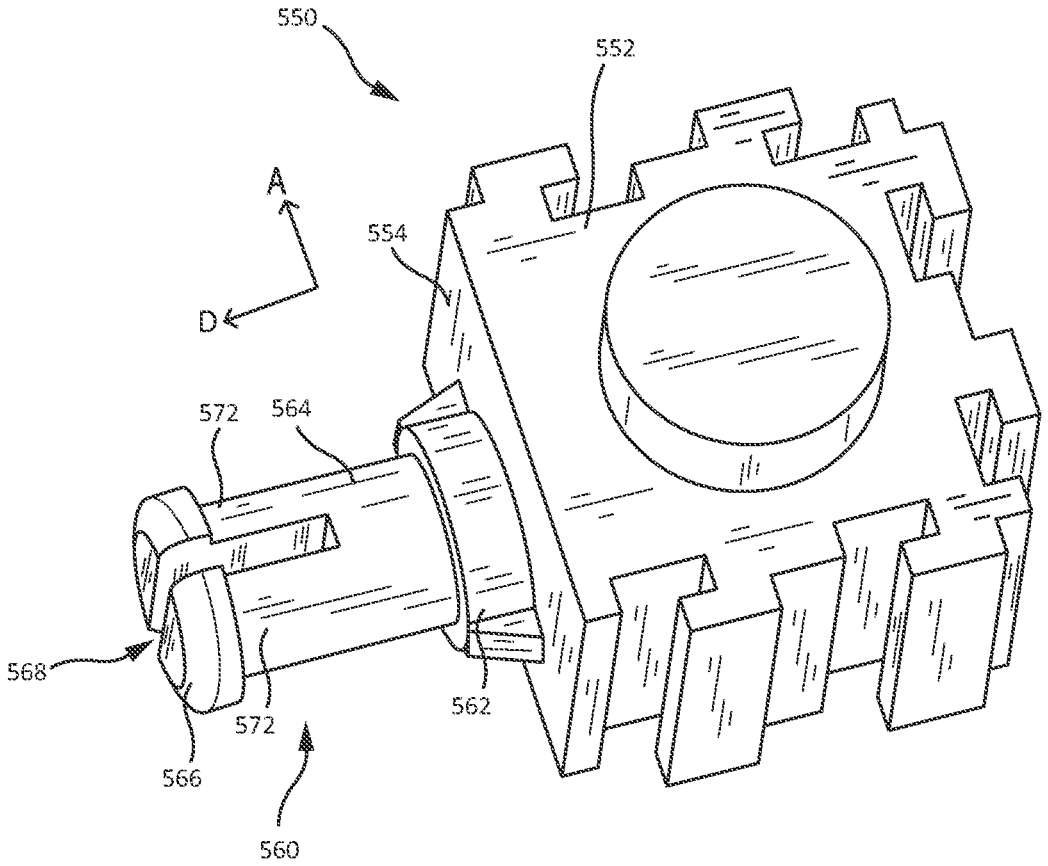
FIGS. 5A and 5B illustrate perspective views of a block having an axle extension coupled to a block side, in accordance with various embodiments.
Figure 5B:
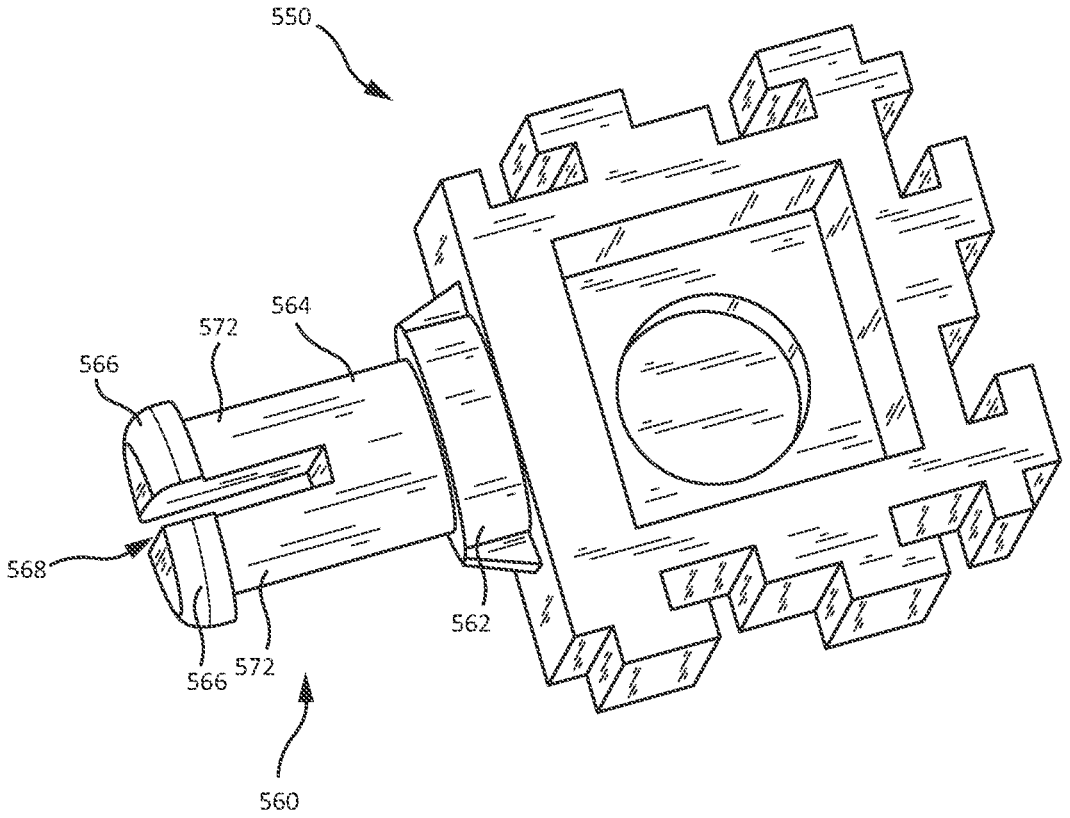

In various embodiments, a block 550 may comprise an axle extension 560 coupled to base 552 of block 550. With reference to FIGS. 5A and 5B, axle extension 560 may be coupled to a block side 554 of base 552, and extend distally and substantially perpendicularly to block side 554. Axle extension 560 may be configured to be inserted through a wheel and be coupled to the wheel, such that the wheel may spin about axle extension 560. Axle extension 560 may comprise an axle base 562 coupled and extending substantially perpendicularly from block side 554. An axle body 564 may be coupled to and extend substantially perpendicularly from axle base 562. In various embodiments, axle body 564 may be coupled directly to base 552. A wheel may be coupled to or disposed about axle body 564. As used in this context, "substantially" means plus or minus 10 degrees from perpendicular.

In various embodiments, axle body 564 may comprise a flange 566 disposed on a distally outer portion of axle body 564 configured to retain a wheel coupled to axle body 564. In various embodiments, axle body 564 may be cylindrical, having a radius, wherein the radius of axle body 564 is less than a radius of flange 566. In various embodiments, axle body 564 may comprise a flex gap 568 creating two axle body arms 572. Flange 566 may, therefore, comprise two pieces, wherein each piece is coupled to a respective axle body arm 572. Flex gap 568 may increase the ease of sliding a wheel onto axle body 564 because axle body arms 572, comprising the flange 566 having a larger radius than axle body 564, may be pressed together, temporarily decreasing the radius of flange 566 and allowing a wheel to slide over flange 566 and onto axle body 564.

In various embodiments, with reference to FIGS. 1A, 6A-C, a block system or kit may comprise a block tool 600. Block tool may be configured to couple to and/or engage block 50 to be able to pull block 50 apart from another block to which block 50 is coupled. In that regard, in various embodiments, block tool 600 may comprise a first end 610 configured to couple to and/or engage a block side of a block having the configuration of connective protrusions shown and described in relation to block side 60 of block 50. In various embodiments, block tool 600 may comprise a second end 640 configured to couple to and/or engage a top insert on a top surface of a block, such as top insert 55 on top surface 54 of block 50. A handle 690 may be disposed between first end 610 and second end 640 such that first end 610 and second end 640 are coupled to handle 690. Handle 690 may be configured for gripping by a user of block tool 600.

Figure 6A:
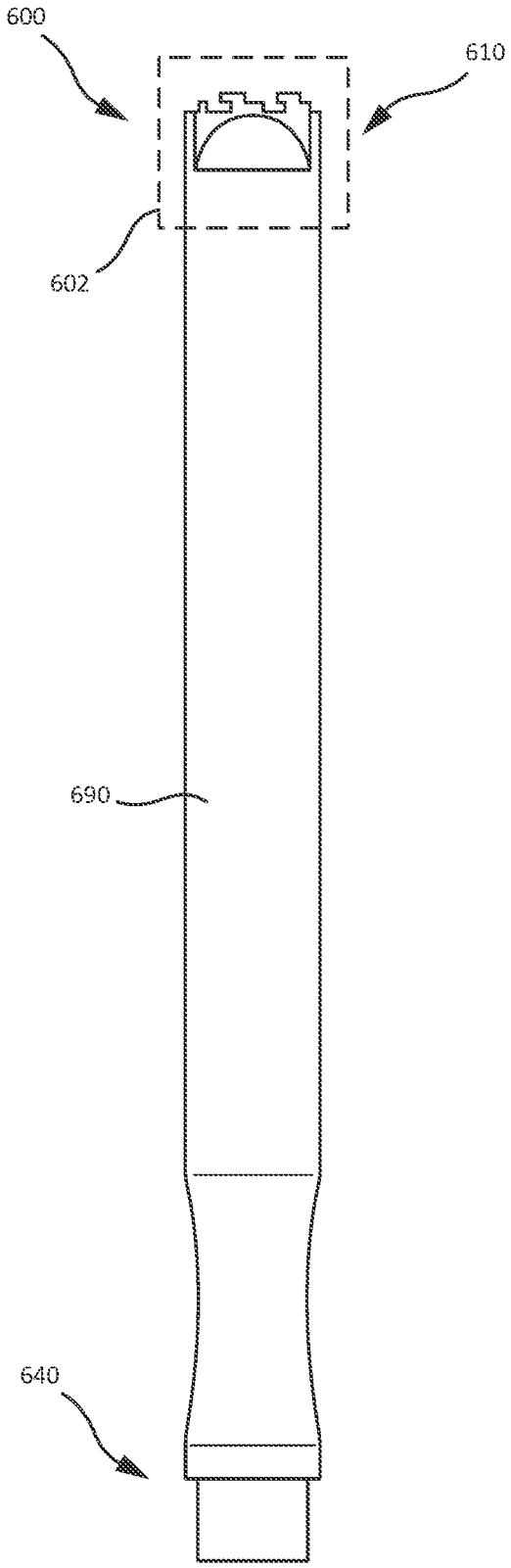
FIG. 6A illustrates a perspective view of a block tool, in accordance with various embodiments.
Figure 6B:
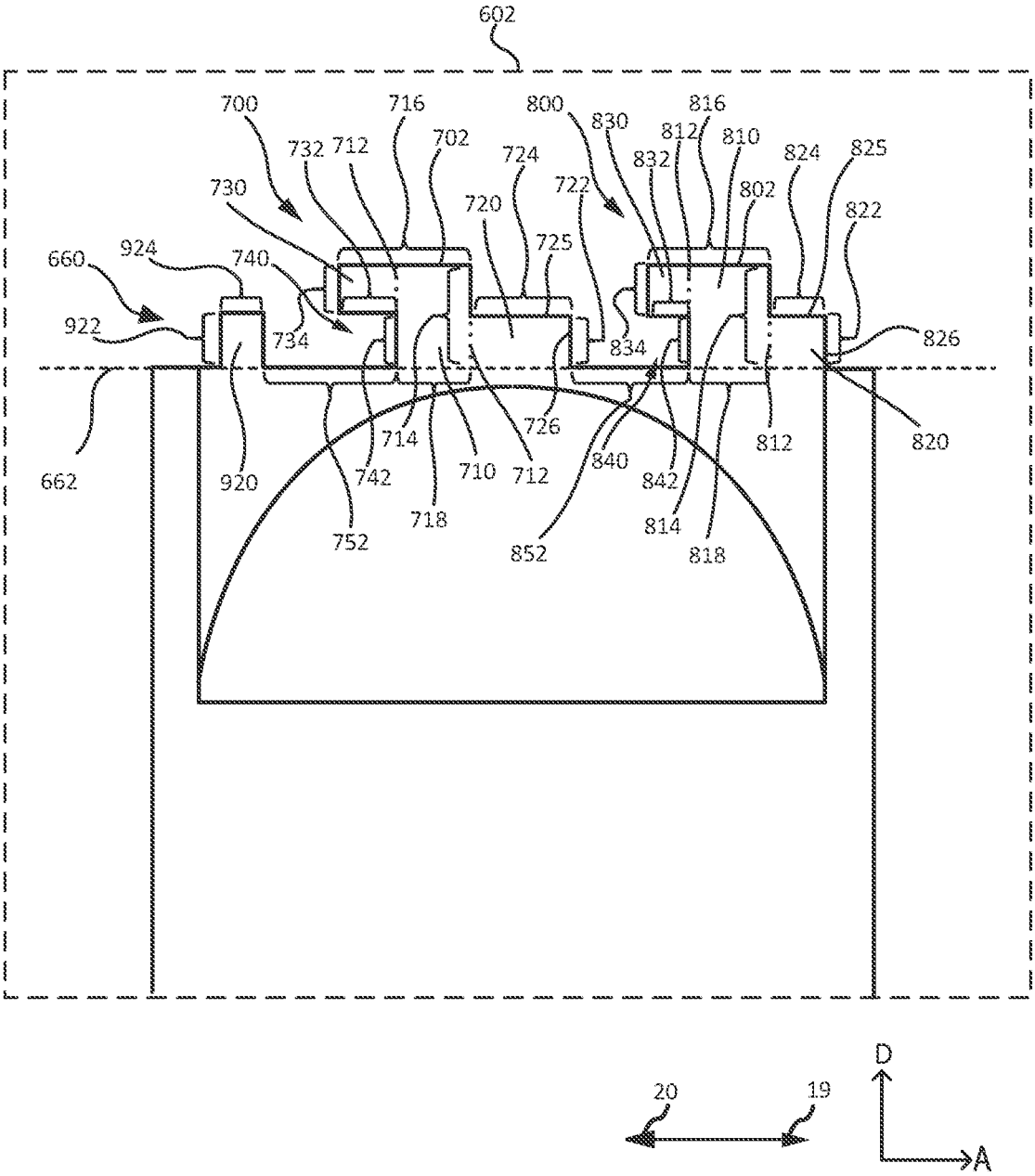
FIG. 6B illustrates a first end of a block tool, in accordance with various embodiments.
Figure 6C:
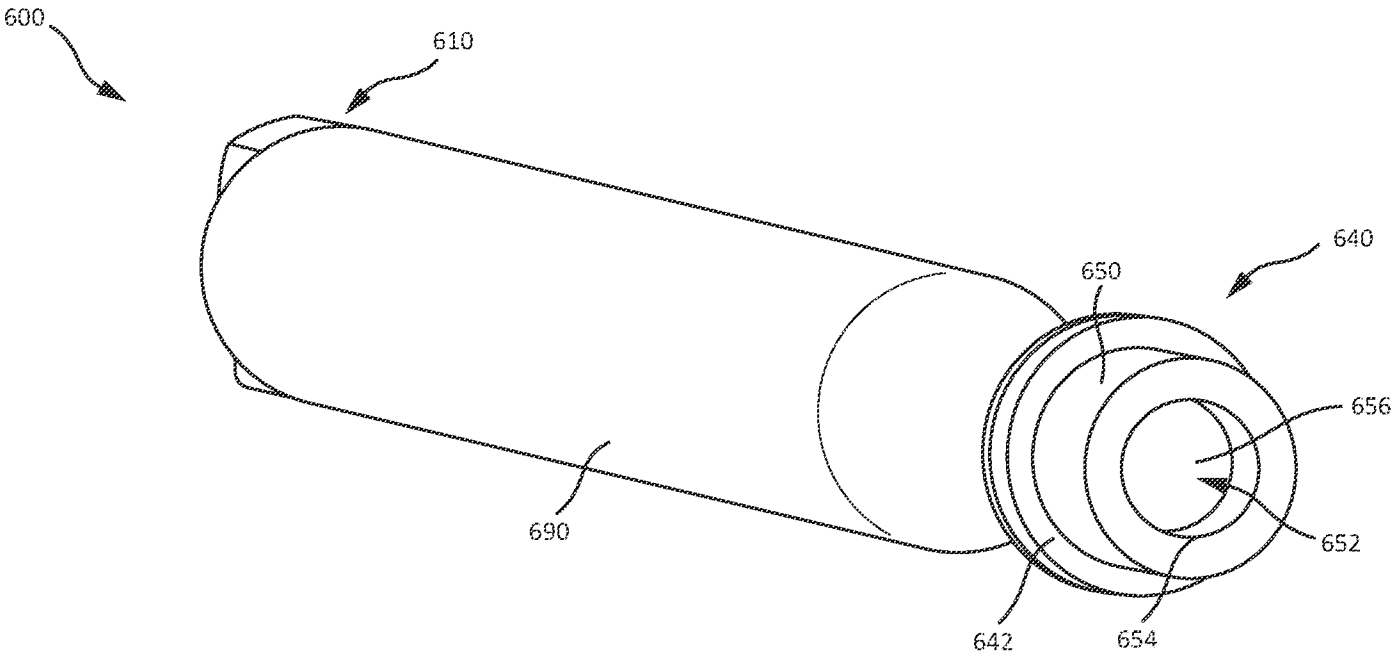
FIG. 6C illustrates another perspective view of a block tool, in accordance with various embodiments.

With continued reference to FIGS. 1A, 6A-C, with box 602 magnifying first end 610 in FIG. 6B, first end 610 of block tool 600 may comprise a configuration of connective protrusions similar, identical, and/or complementary to the configuration of connective protrusions depicted and discussed in FIGS. 1A and 1B. First end 610 may comprise a first end side 660. First end side 660 may have one or more connective protrusions coupled to a first end surface defined by side plane 662 configured to allow first end 610 to couple with block 50 by engaging one or more connective protrusions of block 50. In that regard, a middle connective protrusion 700 (a connective protrusion) may be coupled to the first end surface and protrude substantially perpendicularly from the first end surface (wherein "substantially" means, in this context only, plus or minus 10 degrees from perpendicular). In various embodiments, middle connective protrusion 700 may be disposed in any suitable location along the first end surface. Middle connective protrusion 700 may be adjacent to one or more base surfaces (e.g., base surfaces 752, 852), which are surfaces along the first end surface, or the distally innermost surfaces on the first end surface. Middle connective protrusion 700 may be configured to facilitate the coupling of block tool 600 with block 50 by coupling to, or engaging with, a connective protrusion of block 50.

In various embodiments, middle connective protrusion 700 may be disposed between base surface 752, 852. In various embodiments, middle connective protrusion 700 may comprise a middle center pillar 710 coupled to the first end surface, defined by dotted lines 712. Middle center pillar 710, having a middle center pillar width 718, may extend distally and substantially perpendicularly from the first end surface for a middle center pillar length 714. In various embodiments, middle connective protrusion 700 may further comprise a middle base portion 720 coupled to middle center pillar 710 and the first end surface. Middle base portion 720 may extend axially and substantially perpendicularly in a first direction 19 from middle center pillar 710 for a middle base portion length 724 (an axial distance), having a middle base portion end surface 726 on the opposite end of middle base portion length 724 than middle center pillar 710. Middle base portion 720 may have a middle base portion width 722, which is the distal width middle base portion 720 spans from the first end surface to a middle base portion upper surface 725, the distally outermost surface of middle base portion 720. As used in this context, "substantially" means plus or minus 10 degrees from perpendicular.

In various embodiments, middle connective protrusion 700 may further comprise a middle overhang portion 730 coupled to middle center pillar 710 and protruding axially and substantially perpendicularly from middle center pillar 710 in a second direction 20 for a middle overhang portion length 732. Middle overhang portion 730 may be coupled to middle center pillar 710 above middle base portion width 722 on middle center pillar 710 such that there is a middle overhang space 740 between the first end surface and middle overhang portion 730. A middle overhang portion width 734 of middle overhang portion 730 may span distally between middle overhang space 740 and a middle protrusion top surface 702 (middle overhang portion width 734 may be equal and/or complementary to lateral overhang space width 242). Middle protrusion top surface 702 may have a length 716 equal and/or complementary to the combined lengths of middle center pillar width 718 and middle overhang portion length 732 (length 716 may be equal and/or complementary to the length of base surface 252). A middle overhang space width 742 of middle overhang space 740, the distal distance of middle overhang space 740 between the first end surface and middle overhang portion 730, in various embodiments, may be equal and/or complementary to middle base portion width 722 (middle overhang space width 742 may be equal and/or complementary to lateral overhang portion width 234). In various embodiments, middle connective protrusion 700 may couple with a block 50 by engaging a connective protrusion, or a portion thereof, of the other block 50 being disposed within middle overhang space 740. For example, middle overhang portion 130 or lateral overhang portion 230 of block 50 may be disposed in middle overhang space 740 of block tool 600 to couple block tool 600 and block 50. As used in this context, "substantially" means plus or minus 10 degrees from perpendicular.

In various embodiments, middle connective protrusion 700 may be integral the first end surface. In various embodiments, the components of middle connective protrusion 700 may be integral with one another. That is middle center pillar 710, middle base portion 720, and/or middle overhang portion 730 may be integral with one another. As used herein, "integral" means unitary, such that there are no splits in the material between the integral parts, and/or the integral parts are monolithic.

In various embodiments, the first end surface may alternatively or additionally comprise a lateral connective protrusion 800 (a connective protrusion). Lateral connective protrusion 800 may be disposed axially along the first end surface in any suitable location. For example, lateral connective protrusion 800 may be coupled to the first end surface an axial distance from middle connective protrusion 700. Lateral connective protrusion 800 may be disposed a distance in first direction 19 from middle connective protrusion 700 such that base surface 752 having a base surface length is between lateral connective protrusion 800 and middle connective protrusion 700 (the length of base surface 752 may be equal and/or complementary to length 116). In various embodiments, lateral connective protrusion 800 may be disposed a distance in second direction 20 from middle connective protrusion 700.

In various embodiments, lateral connective protrusion 800 may comprise a lateral center pillar 810 coupled to the first end surface defined by dotted lines 812. Lateral center pillar 810, having a lateral center pillar width 818, may extend distally and substantially perpendicular from the first end surface for a lateral center pillar length 814. In various embodiments, lateral connective protrusion 800 may further comprise a lateral base portion 820 coupled to lateral center pillar 810 and/or the first end surface. Lateral base portion 820 may extend axially and substantially perpendicularly in first direction 19 from lateral center pillar 810 for a lateral base portion length 824 (an axial distance), having a lateral base portion end surface 826 on the opposite end of lateral base portion length 824 than lateral center pillar 810. Lateral base portion 820 may have a lateral base portion width 822, which is the distal width lateral base portion 820 spans from the first end surface to a lateral base portion upper surface 825, the distally outermost surface of lateral base portion 820. As used in this context, "substantially" means plus or minus 10 degrees from perpendicular.

In various embodiments, lateral connective protrusion 800 may further comprise a lateral overhang portion 830 coupled to lateral center pillar 810 and protruding axially and substantially perpendicularly from lateral center pillar 810 in second direction 20 for a lateral overhang portion length 832. Lateral overhang portion 830 may be coupled to lateral center pillar 810 above lateral base portion width 822 on lateral center pillar 810 such that there is a lateral overhang space 840 between the first end surface and lateral overhang portion 830. A lateral overhang portion width 834 of lateral overhang portion 830 may span distally between lateral overhang space 840 and a lateral protrusion top surface 802 (lateral overhang portion width 834 may be equal and/or complementary to middle overhang space width 142). Lateral protrusion top surface 802 may have a length 816 equal and/or complementary to the combined lengths of lateral center pillar width 818 and lateral overhang portion length 832 (length 816 may be equal and/or complementary to the length of base surface 152). A lateral overhang space width 842 of lateral overhang space 840, the distal distance of lateral overhang space 840 between the first end surface and lateral overhang portion 830, in various embodiments, may be equal and/or complementary to lateral base portion width 822 (lateral overhang space width 842 may be equal and/or complementary to middle overhang portion width 134). In various embodiments, lateral connective protrusion 800 may couple with another block 50 by engaging a connective protrusion, or a portion thereof, of the other block 50 being disposed within lateral overhang space 840. As used in this context, "substantially" means plus or minus 10 degrees from perpendicular.

In various embodiments, lateral connective protrusion 800 may be integral with base 52. In various embodiments, the components of lateral connective protrusion 800 may be integral with one another. That is lateral center pillar 810, lateral base portion 820, and/or lateral overhang portion 830 may be integral with one another.

In various embodiments, block side 60 may alternatively or additionally comprise a singular protrusion 920 (a connective protrusion). Singular protrusion 920 may be disposed axially along the first end surface in any suitable location. For example, singular protrusion 920 may be coupled to the first end surface an axial distance from middle connective protrusion 700 or lateral connective protrusion 800. Singular protrusion 920 may be disposed a distance in second direction 20 from middle connective protrusion 700 such that base surface 752 having a base surface length is between middle connective protrusion 700 and singular protrusion 920 (the length of base surface 752 may be equal and/or complementary to length 216). In various embodiments, singular protrusion 920 may be disposed a distance in first direction 19 from middle connective protrusion 700. Singular protrusion 920, may have a singular protrusion width 924, and may be coupled to first end surface and extend distally from the first end surface for a singular protrusion length 922.

In various embodiments, block tool 600 may couple to a block side 60. In response, middle overhang portion 130 may be disposed in lateral overhang space 840. Likewise, lateral overhang portion 830 may be disposed in middle overhang space 140. Base surface 152 may be adjacent to lateral protrusion top surface 802. Middle overhang portion 730 may be disposed in lateral overhang space 240. Lateral overhang portion 230 may be disposed in middle overhang space 740. Base surface 252 may be adjacent to 702. Lateral base portion upper surface 825 may be adjacent to singular protrusion width 324. Singular protrusion width 924 may be adjacent to lateral base portion upper surface 225. In response to coupling block tool 600 to block side 60, the user of block tool 600 may apply force (e.g., use leverage) to remove block 50 from another block to which block 50 is coupled.

In various embodiments, with continued reference to FIGS. 1A, 1B, 6A, and 6B. second end 640 may comprise a second end surface 642 to which a coupling protrusion 650 is coupled. Coupling protrusion 650 protrudes substantially perpendicularly from second end surface 642 and has a protrusion height. Coupling protrusion 650 comprises a cutout perimeter 654 defining a coupling cutout 652, which is a void in coupling protrusion 650. In various embodiments, coupling protrusion 650 comprises a cutout floor 656. Cutout floor 656 may be flush with second end surface 642 or may be axially outward or inward of second end surface 642. The shape of coupling cutout 652 is complementary to the shape of top insert 55 of block 50 such that coupling protrusion 650 may be placed over and couple to top insert 55 by top insert 55 being disposed in coupling cutout 652. In response, the user of block tool 600 may apply force or leverage to block tool 600 and/or block 50 to decouple block 50 from another block.

In various embodiments, blocks described herein may comprise any suitable material or one or more suitable materials. For example, blocks of the present disclosure may be made from a plastic material (i.e. a polymeric material) such as thermoplastics and/or thermosets, as well as metals and metal alloys. In various embodiments, blocks of the present disclosure may be made from composite materials. Blocks of the present disclosure may be manufactured through subtractive or additive manufacturing techniques. In various embodiments, blocks of the present disclosure comprise a polymeric material formed by molding.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A block, comprising:

a base comprising a first block side, wherein the first block side comprises a first side plane defining a first base surface, the first base surface being a distally innermost surface on the first block side;

a lateral connective protrusion coupled to the first block side and extending distally outwardly from the first block side and the first side plane, wherein the lateral connective protrusion is disposed axially along the first block side in a first direction from a middle connective protrusion, wherein a second base surface having a second base surface length spans between the lateral connective protrusion and a middle base portion end surface of a middle base portion, the lateral connective protrusion comprising a lateral center pillar extending distally and perpendicular to the first base surface and a lateral overhang portion protruding axially and perpendicularly from the lateral center pillar in a second direction opposite the first direction; and a lateral base portion coupled to the lateral connective protrusion and extending distally outwardly from a second side plane, the second side plane defined by a second block side, the second block side being orthogonal to the first block side, wherein the lateral base portion extends away from the lateral center pillar in a direction 180 degrees from the second direction; and a middle overhang space comprising a middle overhang space width, which is a distal distance between the first side plane and a middle overhang portion.

2. The block of claim 1, further comprising the middle connective protrusion coupled to the base and extending distally outwardly and substantially perpendicularly from the base and the first side plane, wherein the middle connective protrusion is adjacent to the first base surface and comprises a middle center pillar coupled to the base extending distally outward from the base and the first side plane for a middle center pillar length.

3. The block of claim 2, wherein the middle connective protrusion further comprises the middle base portion coupled to the middle center pillar and the base and extending axially and substantially perpendicularly from the middle center pillar in the first direction for a middle base portion length.

4. The block of claim 3, wherein the middle base portion comprises a middle base portion width being a distance from the middle base portion extends distally outward from the base and the first side plane, and the middle overhang portion coupled to the middle center pillar extending axially and substantially perpendicularly from the middle center pillar in the second direction for a middle overhang portion length such that there is the middle overhang space between the first side plane and the middle overhang portion, wherein the middle overhang portion comprises a middle overhang portion width being a distal distance of the middle overhang portion spanning from the middle overhang space to a middle protrusion top surface of the middle connective protrusion.

5. The block of claim 1, wherein the lateral connective protrusion comprises the lateral center pillar coupled to the base extending distally outward from the base and the first side plane for a lateral center pillar length, and the lateral overhang portion coupled to the lateral center pillar above a lateral base portion width of the lateral center pillar, the lateral overhang portion extending axially and substantially perpendicularly from the lateral center pillar in the second direction for a lateral overhang portion length such that there is a lateral overhang space between the first side plane and the lateral overhang portion, wherein the lateral overhang space comprises a lateral overhang space width, which is a distal distance between the first side plane and the lateral overhang portion, is equal to the lateral base portion width, wherein the lateral overhang space width is equal to a middle overhang portion width.

6. The block of claim 5, wherein the lateral overhang portion comprises a lateral overhang portion width, which is a distal distance of the lateral overhang portion spanning from the lateral overhang space to a lateral top surface of the middle connective protrusion, wherein the lateral overhang portion width is equal to the middle overhang space width.

7. The block of claim 6, wherein the lateral overhang portion comprises a lateral overhang portion end at an axially outermost end of the lateral overhang portion, wherein a gap space spanning axially between the lateral overhang portion end and a middle center pillar is equal to a lower middle protrusion length, which comprises a middle center pillar width and a middle base portion length together.

8. The block of claim 7, wherein the lateral center pillar comprises a lateral center pillar width, wherein the lateral center pillar width and the lateral overhang portion length of the lateral overhang portion together comprise an upper lateral protrusion length, wherein the upper lateral protrusion length is equal to a first base surface length.

9. The block of claim 8, wherein the base further comprises a plurality of block sides, including the first block side, around the base, wherein the base comprises a top surface, and a bottom surface opposite the top surface, wherein the top surface comprises a top insert protruding from the top surface having a top insert shape, and the bottom surface comprises a bottom cutout recessed into the base having a bottom cutout shape that is complementary to the top insert shape.

10. The block of claim 8, wherein the base further comprises a plurality of block sides, including the first block side, around the base, wherein the second block side of the plurality of block sides comprises a second side middle connective protrusion coupled to the base and extending distally outwardly and substantially perpendicularly from the base and the second side plane of the second block side, wherein the second side middle connective protrusion is adjacent to a second side first base surface, wherein the second side middle connective protrusion comprises:

a second side middle center pillar coupled to the base extending distally outward from the base and the second side plane for a second side middle center pillar length;

a second side middle base portion coupled to the second side middle center pillar and the base and extending axially and substantially perpendicularly from the second side middle center pillar in a third direction for a second side middle base portion length, wherein the second side middle base portion comprises a second side middle base portion width being a distance the second side middle base portion extends distally outward from the base and the second side plane; and a second side middle overhang portion coupled to the second side middle center pillar extending axially and substantially perpendicularly from the second side middle center pillar in a fourth second direction opposite the third direction for a second side middle overhang portion length such that there is a second side middle overhang space between the second side plane and the second side middle overhang portion, wherein the second side middle overhang portion comprises a second side middle overhang portion width being a distal distance of the second side middle overhang portion spanning from the second side middle overhang space to a second side middle protrusion top surface of the second side middle connective protrusion, wherein the second side middle overhang space comprises a second side middle overhang space width, which is a distal distance between the second side plane and the second side middle overhang portion, and wherein the second side middle overhang space width is equal to the second side middle base portion width.

11. The block of claim 8, wherein the base further comprises a plurality of block sides, including the first block side, around the base, wherein the second block side of the plurality of block sides comprises an axle extension protruding distally and substantially perpendicularly from the base and the second side plane of the second block side.

12. The block of claim 1, wherein the middle overhang space width is equal to a middle base portion width.

13. The block of claim 2, wherein the middle center pillar, the middle base portion, and the middle overhang portion are integral with one another, and the base, the middle center pillar, and the middle base portion are integral with one another such that the middle connective protrusion is a unitary piece, and wherein the base and the middle connective protrusion are unitary.

14. The block of claim 2, wherein the middle center pillar comprises a middle center pillar width, wherein the middle center pillar width and a middle overhang portion length of the middle overhang portion together comprise an upper middle protrusion length, wherein the upper middle protrusion length is equal to a second base surface length.

15. The block of claim 1, wherein the base further comprises a second block side disposed substantially perpendicularly to the first block side, wherein the second block side comprises a second side middle connective protrusion coupled to the base and extending distally outwardly and substantially perpendicularly from the base and the second side plane of the second block side.

16. The block of claim 15, wherein the second side middle connective protrusion comprises:

a second side middle center pillar coupled to the base and extending distally outward from the base and the second side plane for a second side middle center pillar length;

a second side middle base portion coupled to the second side middle center pillar and the base and extending axially and substantially perpendicularly from the second side middle center pillar in a third direction for a second side middle base portion length, wherein the second side middle base portion comprises a second side middle base portion width being a distance the second side middle base portion extends distally outward from the base and the second side plane; and a second side middle overhang portion coupled to the second side middle center pillar extending axially and substantially perpendicularly from the second side middle center pillar in a fourth direction opposite the third direction for a second side middle overhang portion length such that there is a second side middle overhang space between the second side plane and the second side middle overhang portion, wherein the second side middle overhang portion comprises a second side middle overhang portion width being a distal distance of the second side middle overhang portion spanning from the second side middle overhang space to a second side middle protrusion top surface of the second side middle connective protrusion, wherein the second side middle overhang space comprises a second side middle overhang space width, which is a distal distance between the second side plane and the second side middle overhang portion, and wherein the second side middle overhang space width is equal to the second side middle base portion width.

17. The block of claim 16, further comprising a second side lateral connective protrusion coupled to the second block side and extending distally outwardly from the second block side and the second side plane, wherein the second side lateral connective protrusion is disposed axially along the second block side in the third direction from the second side middle connective protrusion, wherein a second side first base surface having a second side first base surface length spans between the second side lateral connective protrusion and a second side middle base portion end surface of the second side middle base portion.

18. The block of claim 17, wherein the second side lateral connective protrusion comprises a second side lateral center pillar coupled to the base and extending distally outward from the base and the second side plane for a second side lateral center pillar length, and a second side lateral overhang portion coupled to the second side lateral center pillar above a second side lateral base portion width along the second side lateral center pillar, the second side lateral overhang portion extending axially and substantially perpendicularly from the second side lateral center pillar in the fourth direction for a second side lateral overhang portion length such that there is a second side lateral overhang space between the second side plane and the second side lateral overhang portion, wherein the second side lateral overhang space comprises a second side lateral overhang space width, which is a distal distance between the second side plane and the second side lateral overhang portion, and wherein the second side lateral overhang space width is equal to a middle overhang portion width.

* * * * *